United States Patent [19]

Crowe, Jr.

[11] 4,116,448

[45] Sep. 26, 1978

[54] GOLF PRACTICE SIGHTING DEVICE

[76] Inventor: Arthur E. Crowe, Jr., 12 Ruthellen Rd., Framingham, Mass. 01701

[21] Appl. No.: 752,783

[22] Filed: Dec. 20, 1976

[51] Int. Cl.[2] ..... A63B 69/36

[52] U.S. Cl. ..... 273/186 A; 273/186 C; 273/163 A

[58] Field of Search ..... 273/163 R, 163 A, 183 D, 273/183 E, 194 R, 186 A, 186 C

[56] References Cited

U.S. PATENT DOCUMENTS

| | | | |
|---|---|---|---|
| 1,556,062 | 10/1925 | Baugh | 273/163 R X |
| 3,118,678 | 1/1964 | Rohr | 273/163 A |
| 3,421,765 | 1/1969 | Scott | 273/183 D |

*Primary Examiner*—George J. Marlo

*Attorney, Agent, or Firm*—Irving M. Kriegsman

[57] ABSTRACT

A golf practice sighting device which is adapted to be demountably attached to the shaft of a putter for aiding a golfer in accurately aligning the putter with a golf ball and a target. The device includes a viewer containing a 45° mirror. When the viewer is properly positioned the 45° mirror reflects an image of the area directly in front of the putter which can be seen by the golfer when in his normal stance above the golf ball and looking down toward the golf ball. The viewer is clamped to the shaft of the club by an assembly made up of two brackets pivotally connected to each other. The viewer further includes a pair of slidably mounted gauge pins for squaring the device relative to the face of the head of the putter.

5 Claims, 3 Drawing Figures

GOLF PRACTICE SIGHTING DEVICE

BACKGROUND OF THE INVENTION

This invention relates to golfing equipment. More particularly, this invention relates to a golf practice sighting device adapted to be demountably attached to the shaft of a putter for aiding a golfer in accurately aligning the putter with a golf ball and a target.

One of the major difficulties in putting a golf ball is placing the face of the putter exactly at right angles, both horizontally and vertically, to the line extending from the golf ball to the target at the moment of impact of the putter with the ball. If the face of the putter is not properly aligned, the ball will not travel in the desired direction and an unsuccessful shot will result in most all cases. Placement of the putter in the proper position relative to the club head is especially difficult when the ball is even a relatively short distance from the target since the golfer is unable to see the golf ball, the club head and the target at the same time.

Practice type sighting devices that are adapted to be demountably attached to the shaft of the club for assisting the golfer in properly aligning the club relative to the ball and target by enabling the golfer to see the target when looking down in the direction of the ball are well known in the art. For example, one known device includes a viewer having a 45° mirror and a clamping assembly for attaching the viewer to the shaft of the club. When the device is attached to the shaft of the club and the viewer is properly oriented relative to the face of the club, the 45° mirror will reflect an image of any object in the area directly in front of the face of the club that can be seen by the golfer when he is in his normal stance above the golf ball and looking directly down. The clamping assembly is such that the viewer can be adjusted about several different axes so that it can be properly aligned relative to the face of the club and the head of the golfer. One of the problems with the device, however, is that there is no way for accurately squaring the viewer relative to the face of the club. Obviously, in order for the device to be useful, the optical axis of the viewer must be exactly at right angles to the face of the club. Otherwise, the device will not provide a correct indication of whether the club head is properly aligned with the ball and target.

SUMMARY OF THE INVENTION

It is an object of this invention to provide a new and improved golf practice sighting device.

It is another object of this invention to provide a new and improved golf practice sighting device of the type which is adapted to be demountably attached to the shaft of a putter.

It is still another object of this invention to provide a device of the type referred to above which includes means for determining when the device is properly aligned relative to the face of the club.

It is yet still another object of this invention to provide a new and improved viewer for a golf practice sighting device.

It is another object of this invention to provide a new and improved clamping assembly for use in attaching a viewer to the shaft of a putter.

It is still another object of this invention to provide a golf practice sighting device which can be easily attached to and removed from the shaft of a putter, which can be adjusted to accomodate different types of stances which includes a minimum number of parts and which is simple in construction, easy to manufacture and efficient to use.

A golf practice sighting device constructed according to this invention includes a viewer having a 45° mirror and a clamping assembly for demountably attaching the viewer to the shaft of a golf club. The viewer includes means for squaring the viewer relative to the face of the club. The clamping assembly is made up basically of two brackets which are constructed and connected to each other and to the viewer such that the viewer can be rotated about the axis of the shaft of the putter, about an axis parallel to the axis of the shaft of the putter, and about axes perpendicular to each of the aforementioned axes. When mounted and properly positioned the viewer is located about two inches above the head of the club and in front of the face of the club.

The foregoing and other objects and advantages will appear from the description to follow. In the description, reference is made to the accompanying drawings which form a part thereof, and in which is shown by way of illustration a specific embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described by way of examples, with reference to the drawings wherein like reference numerals represent like parts and wherein.

DESCRIPTION OF PREFERRED EMBODIMENT

Figure 1:
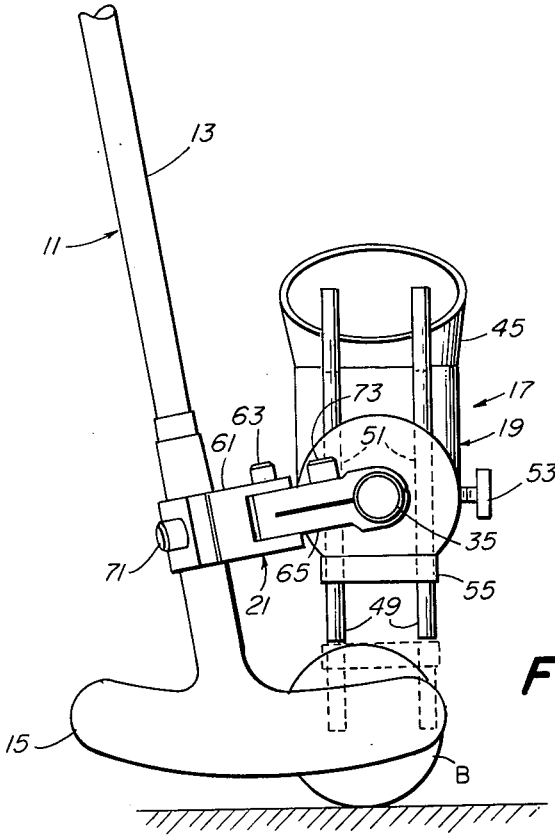
FIG. 1 is a rear elevation view of golf practice sighting device constructed according to this invention mounted for use on a putter.
Figure 2:
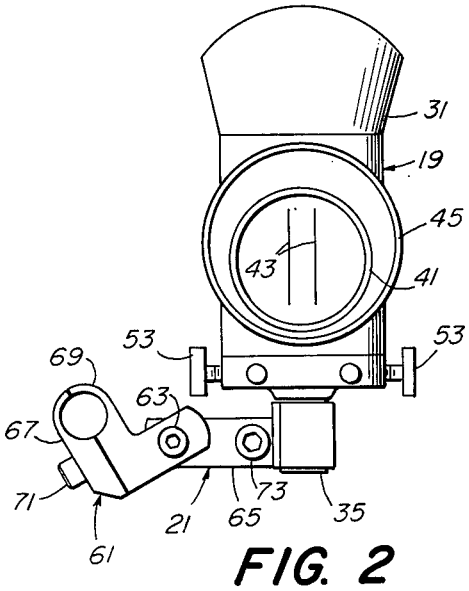
FIG. 2 is a plan view of the golf practice sighting device shown in FIG. 1.
Figure 3:
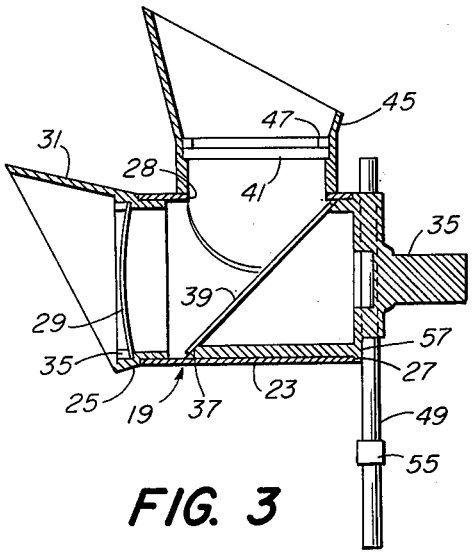
FIG. 3 is a side view of the viewer portion of the golf practice sighting device shown in FIG. 1.

Referring now to the drawings, and first to FIG. 1, there is shown a putter 11 having a shaft 13 and a club head 15. A golf practice sighting device constructed according to this invention and indicated generally by reference numeral 17 is shown in fixed position on the putter 11, about 2 inches up from the club head 15. The sighting device 17 includes a viewer 19 for viewing a flagstick or other target when the head of the user is in the proper position above the golf ball B and looking down in the direction of the golf ball. The sighting device 17 further includes a clamping assembly 21 for demountably attaching the viewer 19 to the shaft 13 of the putter 11.

The viewer 19 includes a housing comprising a cylindrically shaped tubular body member 23 of metal, plastic or other suitable material having a front end 25, a back end 27 and an opening 28 along its sidewall, approximately at the midposition. The cross-sectional diameter of member 23 is preferably slightly less than the diameter of the golf ball B so as not to completely obstruct the golf ball B frow view. In addition, member 23 may be made of a transparent type plastic to allow the area surrounding the golf ball B to be seen when the device is being used. A meniscus lens 29 of relatively low magnification is mounted on a combination sunshade and lens holder 31 which is attached to the front end 25 of the tubular body member 23 by means of screws (not shown). Lens 29 is held in place on holder 31 by a lens retaining ring 33. In an alternate embodiment (not shown), element 29 may have no power and simply be in the form of a window. A body trunnion 35, having a 45° bevelled front edge 37 on which is mounted a front surface mirror 39, is attached to the back end 27 ofthe tubular body member 23 by means of screws (not shown). Front surface mirror 39 is made of aluminized glass or other similar material and is fixedly secured such as by cement to the bevelled front edge 37. A reticle 41 having a pair of parallel reference markings 43 for aligning the viewer 19 with a flagstick or other target is mounted on a combination sunshade and reticle holder 45 which in turn is mounted by screws (not shown) on the main body member 23 over the opening at the midposition. Reticle 41 is held in place on the combination sunshade and reticle holder 45 by means of a reticle retaining ring 47. Lens 29 and reticle 41 may be made of glass, plastic or other suitable material. Viewer 19 further includes a pair of gauge pins 49 for squaring the viewer 19 with the face of the head 15 of the club 13. Gauge pins 49 are mounted for slidable movement within a pair of vertically extending bores 51 in the front portion of the body trunnion member 35 and are secured at any desired position (height) within the body trunnion member 35 by means of clamping screws 53. The plane defined by the two bores 51 is exactly parallel with the plane of the face of the club 13. Gauge pins 49 are fixedly connected by screws (not shown) to a tie bar 55 which keeps the two pins 49 at the same relative height and also enables the user to move the two pins 49 up and down as a unit. When in an uppermost position, tie bar 55 is nestled in a recess 57 in body trunnion 35.

Clamping assembly 21 includes a first bracket 61 having a generally "L" shaped configuration adapted to be clamped at one end on to the shaft 13 of the putter 11 and pivotally mounted at the other end by a clamp screw 63 to one end of a second bracket 65. The body trunnion 35 is pivotally mounted for rotation in a hole on the other end of second bracket 65. Bracket 61 is made up of two parts 67 and 69 and is fixedly secured to shaft 13 in any desired position about the shaft 13 by clamping screw 71. The end of bracket 61 that is pivotally attached to bracket 65 is bifurcated. Bracket 65 has a split section and is secured at any desired angular position on the body trunnion 35 by means of a clamping screw 73. Brackets 61 and 65 may be made of metal, plastic or other suitable material. As can be seen the axis of clamp screw 63 which extends through holes in brackets 61 and 65 is parallel to the axis of shaft 13 and the axis about which trunnion 35 rotates within the hole in bracket 65 is perpendicular to the axis of clamp screw 63. Thus, the entire sighting device 17 can be rotated about the axis of the shaft 13 and the second bracket 65 can be rotated relative to the first bracket 61 about an axis parallel to the shaft 13. With these two degrees of rotation, viewer 19 can be positioned in front of and above the head 15 of club 11 and squared relative to the face of the head 15. By rotating trunnion 35 about second bracket 65, the reticle 41 can be positioned directly below the golfer when he is looking directly down in the direction of the ball B regardless of the angle between the shaft 13 and head 15 of the club 11 and regardless of how the golfer chooses to hold the putter 11 relative to his head.

The device 17 is squared relative to the face of the head 15 of the putter 11 in the following manner. With the device 17 attached to the shaft 13 of putter 11 but with clamping screws 53, 63 and 71 loose, gauge pins 49 are lowered until they are in front of the face of head 15. Clamping screws 53 are then tightened. Brackets 61 and 65 are then rotated until both gauge pins 49 are flat against the face of the head 15. Clamping screws 63 and 71 are then tightened to secure the device 17 in this position. Then gauge pins 49 are raised above the head of the club so as to be out of the way of the face of the club. With tie bar 55 nestled in recess 57, clamping screws 53 are then tightened.

As noted before, the angle between shaft 13 and viewer 19 can be varied to accomodate for the particular stance of the golfer. With the club next to the golf ball B and held by the golfer in the desired position and with the head of the golfer directly above the viewer 19 and looking directly down, viewer 19 is rotated about the axis of the trunnion 35 until reticle 41 is directly in line of sight of the user. Once in the proper position, clamping screw 73 is tightened.

When attached to the putter 11 and properly aligned, viewer 19 is located in front of the face of the head of the putter 11. When the golfer looks down at the viewer 19 he will see through the 45° mirror an area directly in front of the putter along a path exactly perpendicular to the face of the head of the putter. Although the invention has been described with reference to a putter, it is obvious that the device can be attached to and used with other types of golf clubs.

It will be understood that various changes in the details, materials, arrangements of parts and operating conditions which have been herein described and illustrated in order to explain the nature of the invention may be made by those skilled in the art within the principles and scope of the invention.

I claim:

1. A golf practice sighting device for attachment to a golf club comprising:

(a) a viewer adapted to be attached to a golf club for providing a view of a target in front of the club when looking down in the direction of the viewer, (b) means for attaching the viewer directly to the shaft of the club, said means comprising a first bracket adapted to be attached at one end to the shaft of the golf club and a second bracket mounted at one end on to the first bracket for pivotal movement about an axis parallel to the shaft of the club and pivotally attached at the other end to the viewer so as to provide for pivotal movement of the viewer about an axis perpendicular to the pivot axis at the first end of said second bracket, and (c) slidably movable means for aligning the viewer with the face of the head of the club, the slidably movable means for aligning the viewer with the face of the head of the club comprises a pair of gauge pins mounted for slidable movement on the viewer.

2. The invention according to claim 1 and wherein the gauge pins are movable in a vertical direction.

3. The invention according to claim 2 and further including a tie bar rigidly secured to the gauge pins for allowing the gauge pins to be moved as a unit.

4. The invention according to claim 3 and wherein the viewer includes a 45° mirror for providing a view of an area at right angles to the line of sight.

5. The invention according to claim 4 and wherein the viewer includes a tubular member having a body trunnion at one end and wherein said second bracket is mounted at one end of said body trunnion.

* * * * *